US006032586A

United States Patent [19]

Reyes

[11] Patent Number: 6,032,586

[45] Date of Patent: Mar. 7, 2000

[54] ARM RESTING STAND

[76] Inventor: Juan M. Reyes, 2974 17th St., Rockford, Ill. 61109

[21] Appl. No.: 09/238,594

[22] Filed: Jan. 28, 1999

[51] Int. Cl.[7] ..... A47B 9/00; A47B 23/00

[52] U.S. Cl. ..... 108/43; 108/25; 297/188.1

[58] Field of Search ..... 108/43; 11/25, 11/235.6; 297/188.1; 312/235.5

[56] References Cited

U.S. PATENT DOCUMENTS

| | | | |
|---|---|---|---|
| D. 161,172 | 12/1950 | Greene | 297/188.1 X |
| 527,108 | 10/1894 | Cooper | 108/43 |
| 720,776 | 2/1903 | Bennett | 297/188.1 X |
| 4,765,583 | 8/1988 | Tenner | 108/43 X |
| 5,479,866 | 1/1996 | Rae | 108/25 X |
| 5,598,786 | 2/1997 | Patterson | 108/43 |
| 5,680,973 | 10/1997 | Vulpitta et al. | 108/43 X |
| 5,720,226 | 2/1998 | Padovano | 108/25 |
| 5,765,790 | 6/1998 | Kuldvere | 108/43 X |

FOREIGN PATENT DOCUMENTS

| | | | |
|---|---|---|---|
| 731149 | 2/1943 | Germany | 108/43 |

*Primary Examiner*—Peter M. Cuomo
*Assistant Examiner*—Hanh V. Tran

[57] ABSTRACT

An arm resting stand for permitting a user to rest their arms thereon when reading on a toilet. The arm resting stand includes a bin with an open top and a lid substantially covering the open top of the bin. The lid has a resiliently compressible exterior layer. The sides of the bin each comprise a leg panel downwardly depending from the open top of the bin. The sides of the bin each comprise a side panel extending between the leg panels. Each of the side panels has a spaced apart pair of generally semi-circular leg cutouts.

10 Claims, 2 Drawing Sheets

ARM RESTING STAND

BACKGROUND OF THE INVENTION

1. Field of the Invention

The present invention relates to toilet accessories and more particularly pertains to a new arm resting stand for permitting a user to rest their arms thereon when reading on a toilet.

2. Description of the Prior Art

The use of toilet accessories is known in the prior art. More specifically, toilet accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,825,779; U.S. Pat. No. 5,144,898; U.S. Pat. No. 5,598,786; U.S. Pat. No. 4,850,286; U.S. Pat. No. Des. 355,786; and U.S. Pat. No. 2,039,922.

While these devices fulfill their respective, particular objectives and requirements, the aforementioned patents do not disclose a new arm resting stand. The inventive device includes a bin with an open top and a lid substantially covering the open top of the bin. The lid has a resiliently compressible exterior layer. The sides of the bin each comprise a leg panel downwardly depending from the open top of the bin. The sides of the bin each comprise a side panel extending between the leg panels. Each of the side panels has a spaced apart pair of generally semi-circular leg cutouts.

In these respects, the arm resting stand according to the present invention substantially departs from the conventional concepts and designs of the prior art, and in so doing provides an apparatus primarily developed for the purpose of permitting a user to rest their arms thereon when reading on a toilet.

SUMMARY OF THE INVENTION

In view of the foregoing disadvantages inherent in the known types of toilet accessories now present in the prior art, the present invention provides a new arm resting stand construction wherein the same can be utilized for permitting a user to rest their arms thereon when reading on a toilet.

The general purpose of the present invention, which will be described subsequently in greater detail, is to provide a new arm resting stand apparatus and method which has many of the advantages of the toilet accessories mentioned heretofore and many novel features that result in a new arm resting stand which is not anticipated, rendered obvious, suggested, or even implied by any of the prior art toilet accessories, either alone or in any combination thereof.

To attain this, the present invention generally comprises a bin with an open top and a lid substantially covering the open top of the bin. The lid has a resiliently compressible exterior layer. The sides of the bin each comprise a leg panel downwardly depending from the open top of the bin. The sides of the bin each comprise a side panel extending between the leg panels. Each of the side panels has a spaced apart pair of generally semi-circular leg cutouts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new arm resting stand apparatus and method which has many of the advantages of the toilet accessories mentioned heretofore and many novel features that result in a new arm resting stand which is not anticipated, rendered obvious, suggested, or even implied by any of the prior art toilet accessories, either alone or in any combination thereof.

It is another object of the present invention to provide a new arm resting stand which may be easily and efficiently manufactured and marketed.

It is a further object of the present invention to provide a new arm resting stand which is of a durable and reliable construction.

An even further object of the present invention is to provide a new arm resting stand which is susceptible of a low cost of manufacture with regard to both materials and labor, and which accordingly is then susceptible of low prices of sale to the consuming public, thereby making such arm resting stand economically available to the buying public.

Still yet another object of the present invention is to provide a new arm resting stand which provides in the apparatuses and methods of the prior art some of the advantages thereof, while simultaneously overcoming some of the disadvantages normally associated therewith.

Still another object of the present invention is to provide a new arm resting stand for permitting a user to rest their arms thereon when reading on a toilet.

Yet another object of the present invention is to provide a new arm resting stand which includes a bin with an open top and a lid substantially covering the open top of the bin. The lid has a resiliently compressible exterior layer. The sides of the bin each comprise a leg panel downwardly depending from the open top of the bin. The sides of the bin each comprise a side panel extending between the leg panels.

Each of the side panels has a spaced apart pair of generally semi-circular leg cutouts.

Still yet another object of the present invention is to provide a new arm resting stand that holds books and magazines so that a user can quickly retrieve and store them while sitting on a toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
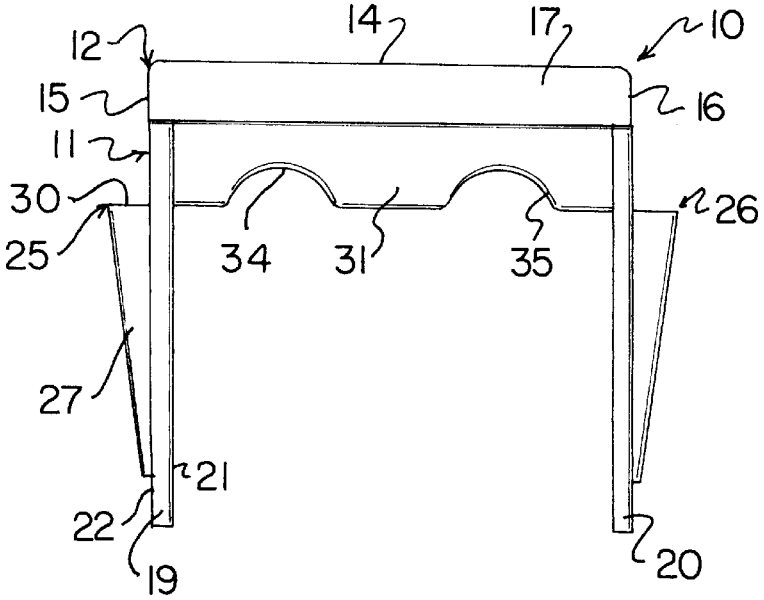
FIG. 1 is a schematic side view of a new arm resting stand according to the present invention.
Figure 2:
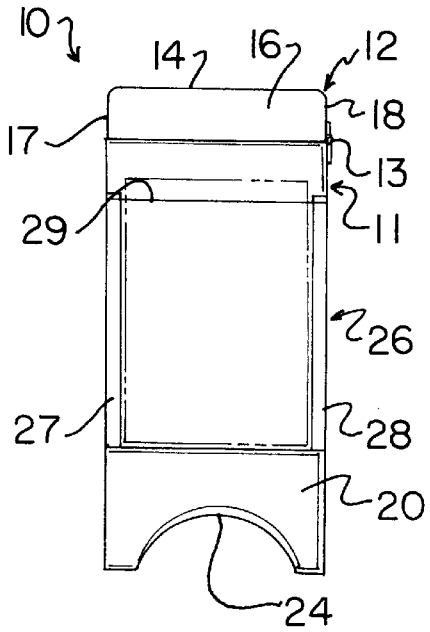
FIG. 2 is a schematic end view of the present invention.
Figure 3:
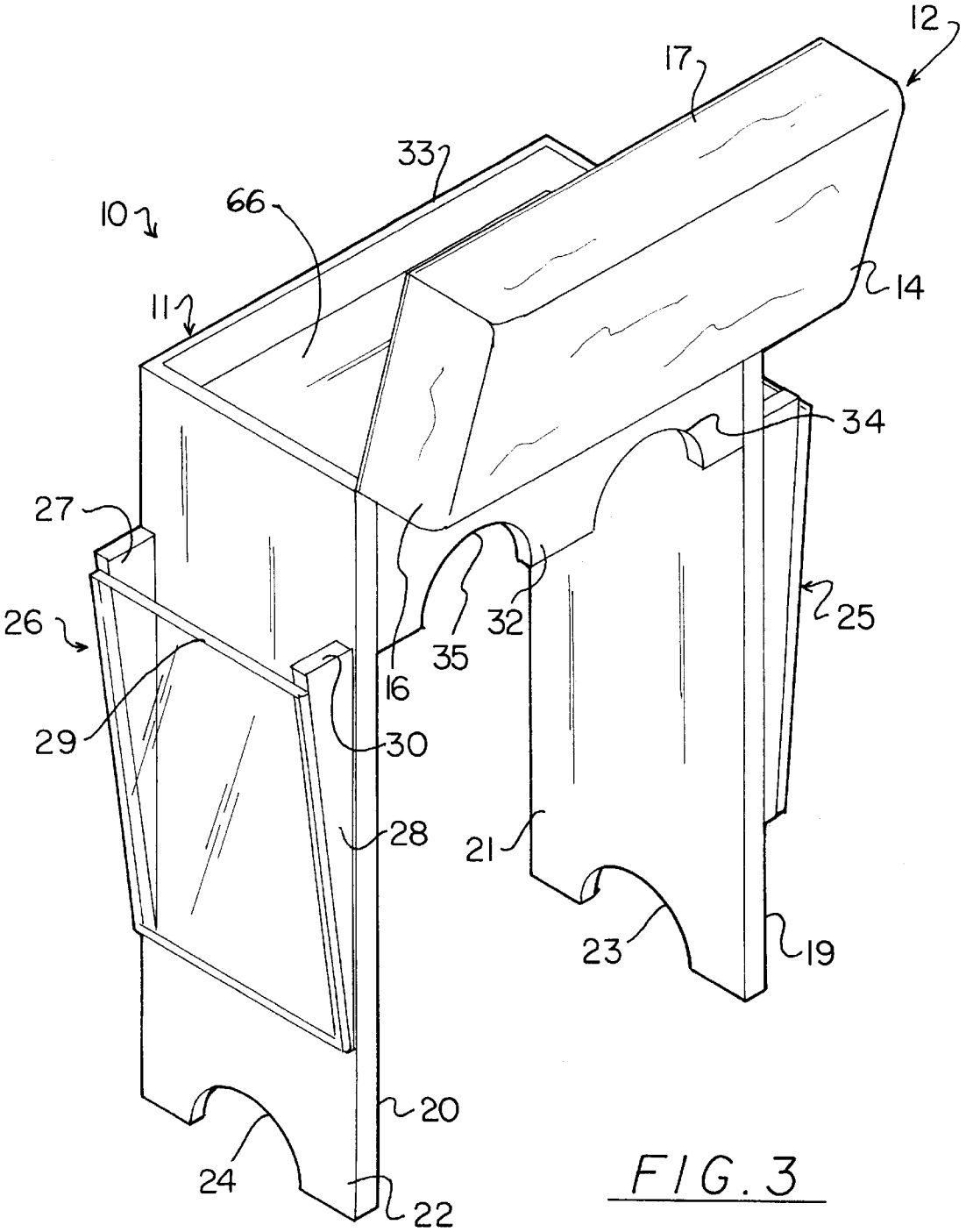
FIG. 3 is a schematic perspective view of the present invention with the lid pivoted open.

With reference now to the drawings, and in particular to FIGS. 1 through 3 thereof, a new arm resting stand embodying the principles and concepts of the present invention and generally designated by the reference numeral 10 will be described.

As best illustrated in FIGS. 1 through 3, the arm resting stand 10 generally comprises a bin with an open top and a lid substantially covering the open top of the bin. The lid has a resiliently compressible exterior layer. The sides of the bin each comprise a leg panel downwardly depending from the open top of the bin. The sides of the bin each comprise a side panel extending between the leg panels. Each of the side panels has a spaced apart pair of generally semi-circular leg cutouts.

In use, the arm resting stand 10 is designed for positioning over the lap of a user sitting on a toilet so that the user has a comfortable place to rest their arms on when reading on the toilet. In closer detail, the arm resting stand 10 includes a generally rectangular bin 11 having an open top, a bottom 66, a pair of ends, and a pair of sides extending between the ends of the bin. In use, the bin is designed for holding items such as books and magazines therein. The open top of the bin has a generally rectangular peripheral edge 33. A generally rectangular padded lid 12 substantially covers the open top of the bin. The lid is pivotally coupled by hinges 13 to one of the sides of the bin. In use, the lid is designed for resting thereon the arms of a user sitting on a toilet.

Preferably, the lid has generally flat rectangular top and bottom faces, a pair of generally flat rectangular end faces and a pair of generally rectangular side faces. The bottom face of the lid is rested on the peripheral edge of the bin. The lid has a resiliently compressible exterior layer for providing cushioning to the arms of the user resting thereon. The exterior layer is substantially coextensive with the top face 14 and each of the end and side faces 15,16, 17,18 of the lid.

The sides of the bin each comprising a leg panel 19,20 downwardly depending from the open top of the bin. Each of the leg panels is generally rectangular and has substantially planar inner and outer faces 21,22, generally straight top and bottom end edges, and a pair of generally straight side edges extending between the top and bottom ends of the respective leg panel. The top end edges of the legs panels each define an adjacent portion of the peripheral edge of the open top of the bin. Preferably, legs panels lie in substantially parallel vertical planes to one another with the inner faces of the leg panels facing one another. Ideally, each of the side edges of one of the leg panels generally lies in a common plane with an associated side edge of the other of the leg panels.

In use, the bottom edges of the legs panels are designed for resting on a resting surface such as a floor structure. Preferably, the bottom edges of the leg panels each have a generally semicircular cutout 23,24. The cutouts of the bottom edges of the legs panels are preferably positioned generally equidistant between the associated side edges of the respective leg panel.

In the preferred embodiment, each of the legs panels has magazine rack 25,26 coupled to the outer face of the respective leg panel. Each of the magazine racks comprises a spaced apart and substantially parallel pair of generally triangular side blocks 27,28 and a generally rectangular outer panel 29. Preferably, one of the side blocks of each magazine rack is positioned adjacent one of the side edges of the associated leg panel and the other of the side blocks of each magazine rack is positioned adjacent the other side edge of the associated leg panel. The side blocks of each of the magazine racks each have a pair of lower sides converging towards the bottom edge of the associated leg panel. Each of the side blocks has an upper side 30 extending substantially perpendicular to the outer face of the associated leg panel. The outer panel of each of the magazine rack is coupled to the outermost lower side of each of the associated side blocks of the respective magazine rack. The outer panels of the magazine racks each is generally rectangular and comprising a translucent and ideally a generally transparent material. The outer panel of each magazine rack and the outer face of the associated leg panel define a space therebetween designed for receiving magazines and other reading materials therein.

The sides of the bin each comprise a generally rectangular side panel 31,32 extending between the leg panels. Each of the side panels has generally straight and substantially parallel upper and lower edges. The upper edges of the side panels each defining an adjacent portion of the peripheral edge of the open top of the bin. In use, the bin is designed for positioning over the lap of a user sitting on a toilet with the bottom edges of the legs resting on the floor one either side of the toilet. The lower edges of the side panels each have a spaced apart pair of generally semi-circular leg cutouts 34,35 designed for extending therethrough the lap of a user sitting on the toilet. Preferably, each of the leg cutouts of one of the side panels is substantially coaxial with an associated leg cutout of the other side panel.

In an ideal illustrative embodiment, the legs panels each have a length defined between the top and bottom end edges of about 24 inches. In this illustrative embodiment, the bin has a width defined between the outer faces of the leg panels of about 23 inches and a depth defined between the side panels of about 9½ inches.

In use, a user sitting on a toilet positions the bin over the user's lap so that thighs of the user are extended through the leg cutouts and the leg panels are positioned on either side of the toilet. The user may then rest their arms on the lid while reading. When the user is finished reading, the reading material may be stored in the magazine racks or the user may pivot open the lid to store the reading material in the bin.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An arm resting stand, comprising:

a bin having an open top, a bottom, a pair of ends, and a pair of sides extending between said ends of said bin;

a lid substantially covering said open top of said bin;

said lid having a resiliently compressible exterior layer;

said ends of said bin each comprising a leg panel downwardly extending from said open top of said bin;

said sides of said bin each comprising a side panel extending between said leg panels; and each of said side panels having a spaced apart pair of generally semi-circular leg cutouts.

2. The arm resting stand of claim 1, wherein said lid is pivotally coupled to one of said sides of said bin.

3. The arm resting stand of claim 1, wherein said lid has generally flat rectangular top and bottom faces, a pair of generally flat rectangular end faces and a pair of generally rectangular side faces, said bottom face of said lid being rested on a peripheral edge of said bin defining said open top of said bin, and wherein said exterior layer of said lid is substantially coextensive with said top, end, and side faces of said lid.

4. The arm resting stand of claim 1, wherein each of said leg panels has top and bottom edges and a pair of side edges extending between said top and bottom edges of the respective leg panel, wherein said bottom edges of said leg panels each have a cutout, said cutouts of said bottom edges of said legs panels being positioned generally equidistant between the associated side edges of the respective leg panel.

5. The arm resting stand of claim 1, wherein each of said leg panels has a magazine rack coupled thereto.

6. The arm resting stand of claim 5, wherein each of said magazine racks comprising a spaced apart pair of side blocks and a outer panel, said side blocks of each of said magazine racks being coupled to the associated leg panel, said outer panel of each of said magazine racks being coupled to each of the side blocks of the respective magazine rack.

7. The arm resting stand of claim 6, wherein said side blocks of each of said magazine racks each are generally triangular and have a pair of lower sides converging in a downwards direction, each of said side blocks having an upper side extending substantially perpendicular to the associated leg panel.

8. The arm resting stand of claim 6, wherein said outer panels of said magazine racks each comprise a translucent material.

9. The arm resting stand of claim 1, wherein each of said leg cutouts of one of said side panels is substantially coaxial with an associated leg cutout of the other side panel.

10. An arm resting stand for positioning over the lap of a user sitting on a toilet, said arm resting stand comprising:

a generally rectangular bin having an open top, a bottom, a pair of ends, and a pair of sides extending between said ends of said bin;

said open top of said bin having a generally rectangular peripheral edge;

a generally rectangular lid substantially covering said open top of said bin, said lid being pivotally coupled to one of said sides of said bin;

said lid having generally flat rectangular top and bottom faces, a pair of generally flat rectangular end faces and a pair of generally rectangular side faces;

said bottom face of said lid being rested on said peripheral edge of said bin;

said lid having a resiliently compressible exterior layer, said exterior layer being substantially coextensive with said top, end, and side faces of said lid;

said ends of said bin each comprising a leg panel downwardly extending from said open top of said bin;

each of said leg panels being generally rectangular and having substantially planar inner and outer faces, generally straight top and bottom end edges, and a pair of generally straight side edges extending between said top and bottom ends of the respective leg panel;

said leg panels lying in substantially parallel planes to one another;

said inner faces of said leg panels facing one another;

each of said side edges of one of said leg panels generally lying in a common plane with an associated side edge of the other of said leg panels;

said top end edges of said legs panels each defining an adjacent portion of said peripheral edge of said open top of said bin;

said bottom edges of said leg panels each having a generally semi-circular cutout, said cutouts of said bottom edges of said legs panels being positioned generally equidistant between the associated side edges of the respective leg panel;

each of said leg panels having a magazine rack coupled to the outer face of the respective leg panel;

each of said magazine racks comprising a spaced apart and substantially parallel pair of generally triangular side blocks and a generally rectangular outer panel;

one of said side blocks of each magazine rack being positioned adjacent one of said side edges of the associated leg panel, the other of said side blocks of each magazine rack being positioned adjacent the other side edge of the associated leg panel;

said side blocks of each of said magazine racks each having a pair of lower sides converging towards the bottom edge of the associated leg panel, each of said side blocks having an upper side extending substantially perpendicular to the outer face of the associated leg panel;

said outer panels of said magazine racks each comprising a translucent material;

said outer panel of each of said magazine racks being coupled to one of said lower sides of each of said side blocks of the respective magazine rack;

said sides of said bin each comprising a generally rectangular side panel extending between said leg panels;

each of said side panels having generally straight and substantially parallel upper and lower edges, said upper edges of said side panels each defining an adjacent portion of said peripheral edge of said open top of said bin;

said lower edges of said side panels each having a spaced apart pair of generally semi-circular leg cutouts; and each of said leg cutouts of one of said side panels being substantially coaxial with an associated leg cutout of the other side panel.

* * * * *